US005425155A

United States Patent [19]

Marciniak

[11] Patent Number: 5,425,155

[45] Date of Patent: Jun. 20, 1995

[54] DOOR OPENING DEVICE FOR WHEELCHAIR-BOUND PERSONS

[76] Inventor: David S. Marciniak, 34 Crow Hill Rd., Freehold, N.J. 07728-9602

[21] Appl. No.: 40,505

[22] Filed: Mar. 31, 1993

[51] Int. Cl.[6] ..... E05B 7/00

[52] U.S. Cl. ..... 16/112

[58] Field of Search ..... D16/112, 110 R; 292/DIG. 15, 336.3

[56] References Cited

U.S. PATENT DOCUMENTS

| | | | |
|---|---|---|---|
| 1,203,965 | 11/1916 | Bogenburger | 16/110 R |
| 2,632,537 | 3/1953 | Marchand | 49/460 |
| 2,870,493 | 1/1959 | Beyrle | 16/111 R |
| 4,494,784 | 1/1985 | Haynes | 292/DIG. 15 |
| 4,783,883 | 11/1988 | Szalay . | |
| 4,908,906 | 3/1990 | Hanna . | |
| 5,005,255 | 4/1991 | Pare et al. . | |

FOREIGN PATENT DOCUMENTS

| | | | |
|---|---|---|---|
| 197806 | 6/1978 | France | 292/92 |

*Primary Examiner*—Linda B. Johnson
*Attorney, Agent, or Firm*—Howson & Howson

[57] ABSTRACT

A substantially L-shaped grasping bar is hingedly attached to the hinge stile and the latch stile of a door. An upper surface of the latch stile attachment is placed adjacent the underside of the latch handle so that upon lifting the grasping bar, the latch is activated and the door can be easily manipulated by a wheelchair-bound person.

13 Claims, 5 Drawing Sheets

DOOR OPENING DEVICE FOR WHEELCHAIR-BOUND PERSONS

BACKGROUND OF THE INVENTION

When passing through a doorway, where the door is hinged to the frame on one side and has a latch handle mechanism, for example, on the other side to keep it closed, a pedestrian tends to divert from a straight line direction of travel after unlatching the door and moving it off center. When the door swings away from the individual, he tends to veer off to the side rather than pushing the door fully open to be able to stay on a straight-line path. In the case when the door swings toward the person, he must back-step and then circle around the side of the door. Certainly, extra steps are required, but usually these steps are taken without a moment's hesitation or any extra effort.

This is not the normal procedure for a wheelchair-bound person, though. In the case where a door opens toward an individual in a wheelchair, that person must first maneuver up to the door in order to reach and unlatch the handle. Now that the handle is unlatched, the person must keep a grasp on the handle while backing the wheelchair away from the doorway in order to sufficiently swing the door open wide enough to pass the wheelchair through. Backing away from the doorway in a manual, i.e. nonpowered, wheelchair causes an asymmetric force on the wheelchair due to the use of one arm. Since a person's reach in a wheelchair is approximately at the location of their footrests, the opened door will always tend to "hug" the chair, thus limiting space to maneuver in.

When the door must be opened away from a person in a wheelchair, the task can be equally as difficult. Again, the first step is for the individual to maneuver up to the door to unlatch the handle. Now they must simultaneously push the door open while maneuvering the wheelchair through the door. For one thing, as the door opens, the corner of the wheelchair closest to the hinged edge of the door will be repeatedly blocked by the door until the door is fully opened. Also, as the door opens, the latch edge moves out of reach of the individual thus requiring more and more "stretch" to make the reach or that the person must push on the door nearer and nearer to the hinged edge. Pushing near the hinged edge or stile of the door requires a significantly greater force than pushing on the latch edge or stile due to the shorter moment arm. And, again, whenever the person is in a manual wheelchair, he or she must operate the wheelchair with one arm, again putting an asymmetric load on the operation, something which requires correction for the wheelchair to move along a desired path through the doorway.

For the wheelchair-bound person, the solution would be a device that not only assists in unlatching the door, but also allows the user to maintain a relatively straight pathway through the doorway. It would allow the user to minimize unbalanced loads on the wheelchair while simultaneously minimizing the movement of the wheelchair while it is worked through the doorway.

SUMMARY OF THE INVENTION

It is therefore an object of the present invention to provide a device which assists a wheelchair-bound person in unlatching a latch handle, hinged door.

It is another object of the present invention to provide a device that will simultaneously assist a wheelchair-bound person in unlatching a door and moving it out of the path of the wheelchair.

It is a still further object of the present invention to provide such a device that may be retrofitted to existing latch-handle doors or installed on new doors.

It is a still further object of the present invention to provide such a device that when retrofitted to existing latch-handle doors or installed on new doors will not interfere with the operation of the door by pedestrians.

These and other objects and advantages will become apparent with the door opening device for wheelchair-bound persons.

The device comprises a substantially L-shaped grasping bar hingedly attached to the hinge stile and the latch stile of the door and adjacent the latch handle. In the unused position, the grasping bar will merely hang in a substantially vertical position alongside the face of the door. When it is to be used, the wheelchair-bound person lifts up the grasping bar and forces an upper edge of the attachment portion to activate the latch handle. Once the latch handle has been unlatched, the person uses the outward-extending and angled grasping bar to manipulate the door accordingly. As an alternate embodiment, an extension pin may be fastened to the handle, on the opposite side from the latch. With this embodiment, the latch stile stanchion, or hinge arrangement, is placed on the opposite side of the handle.

The novel features which are believed to be characteristics of the invention, both as to its organization and methods of operation, together with further objects and advantages thereof, will be better understood from the following descriptions in connection with the accompanying drawings in which the presently preferred embodiments of the invention are illustrated by way of examples. It is to be expressly understood, however, that the drawings are for purposes of illustration and description only and are not intended as a definition of the limits of the invention.

DETAILED DESCRIPTION OF THE PREFERRED EMBODIMENT

Figure 1:
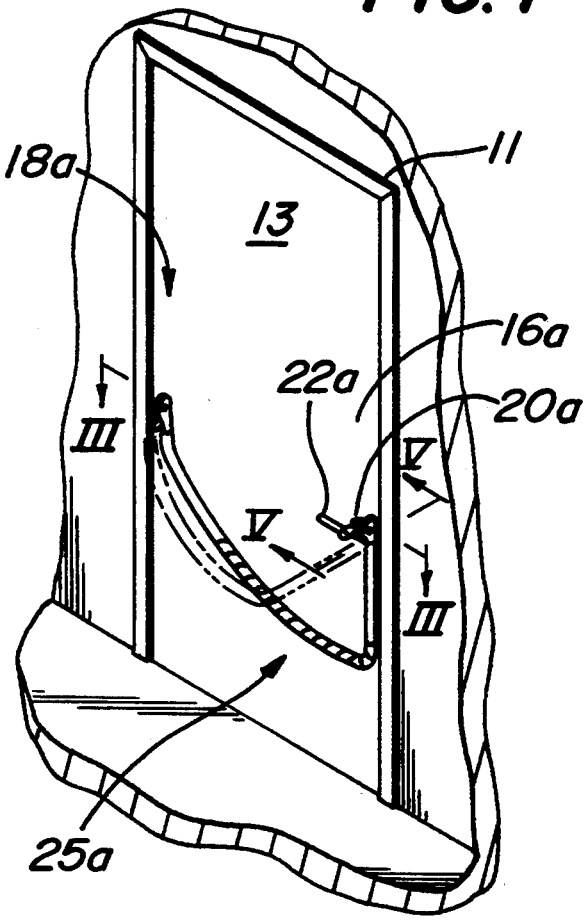
FIG. 1 shows a perspective view of one face of a door having a lever-action latch with the instant invention installed and with the bar shown in the raised position by phantom lines.
Figure 2:
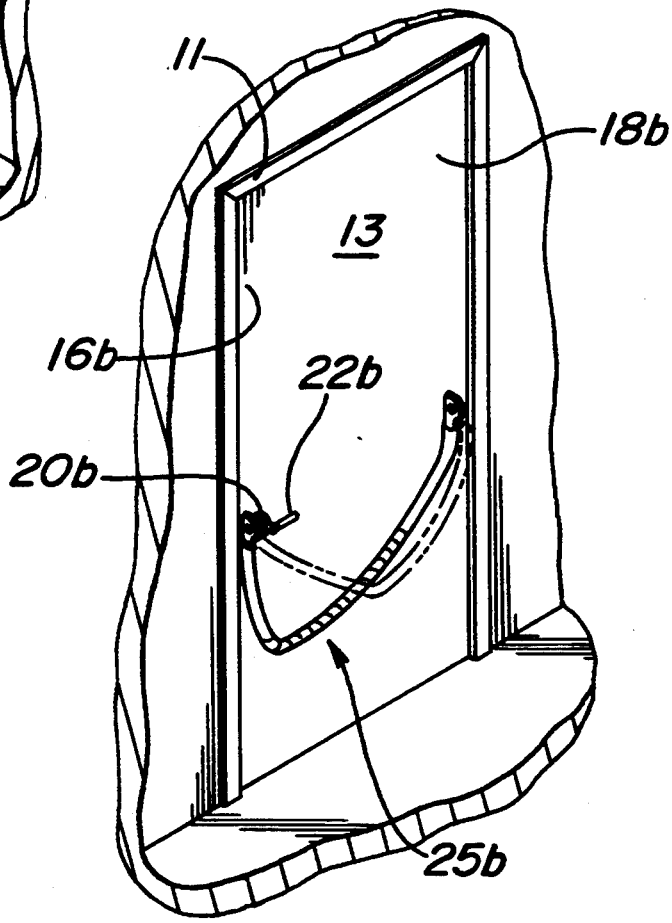
FIG. 2 shows a perspective view of the opposite face of the door of FIG. 1 with the instant invention installed and with the bar shown in the raised position by phantom lines.

Referring now to the drawings, where like reference characters designate like or corresponding parts throughout the several views, there is illustrated in FIG. 1 a perspective view of one face, for example, the inside, of a door 13 hingedly fixed in a doorway 11 with the instant invention attached. FIG. 2 shows a perspective view of the opposite face, for example, the outside, of door 13 with the instant invention attached, To simplify the description of the parts of the door and the invention, for purposes of this section, the letter "a" will be used to designate parts on the inside of the door and the letter "b" will be used to designate corresponding parts on the outside of the door. The latch stile 16 on the inside of the door is shown to the right side of FIG. 1 and the hinge stile 18 on the inside of door 13 is shown to the left side (hinges, as normally known in the art, not shown in FIGS. 1 or 2). In like manner, a lever-action latch mechanism 20, as is known in the industry, is shown attached on latch stile 16, at a standard position on door 13 and has a lever latch handle 22 extending therefrom. The instant invention, a door opening device for wheelchair-bound persons, is referred to generally as 25 in the drawings.

Figure 3:
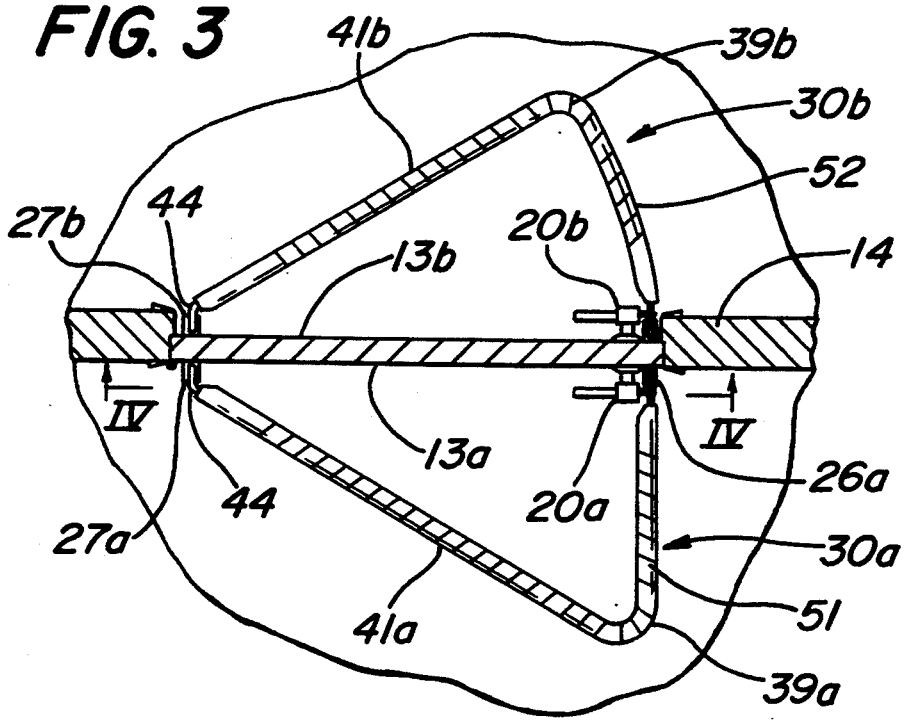
FIG. 3 shows a cross-sectional view of the door and invention taken along lines III—III of FIG. 1 showing the invention with the bar in the raised position.

FIG. 3 shows a cross-sectional view of door 13, as taken along lines III—III of FIG. 1 and gives a plan view of the instant invention. As can be seen clearly in FIGS. 4, 5 and 6, partially broken away and enlarged views of specific portions of the instant invention, in one embodiment, latch mechanism 20 can have an extension bar 23 affixed thereto on the opposite side from latch handle 22, substantially diametrically opposite from handle 22. As will be explained below, in another embodiment of the invention, no latch handle extension is used. Bar 23 can be a steel pin of approximately ½ inch diameter, of a length of between 2 to 2 and ½ inches long, and can optionally have a plastic, or similar type material, protective sleeve 24 around it. Pin 23 can be journalled into latch mechanism 20 to fix it against movement.

Figure 4:
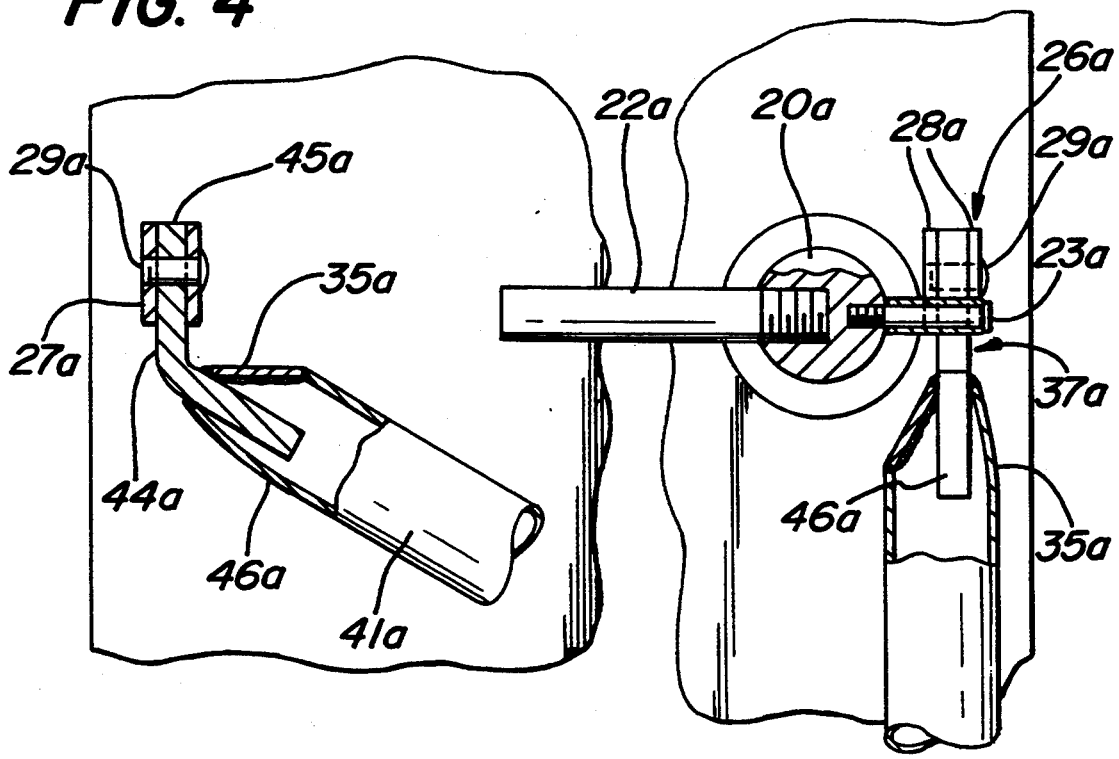
FIG. 4 shows a partially broken away cross-sectional view taken along lines IV—IV of FIG. 3 showing the bar in the down, or hanging, position.
Figure 5:
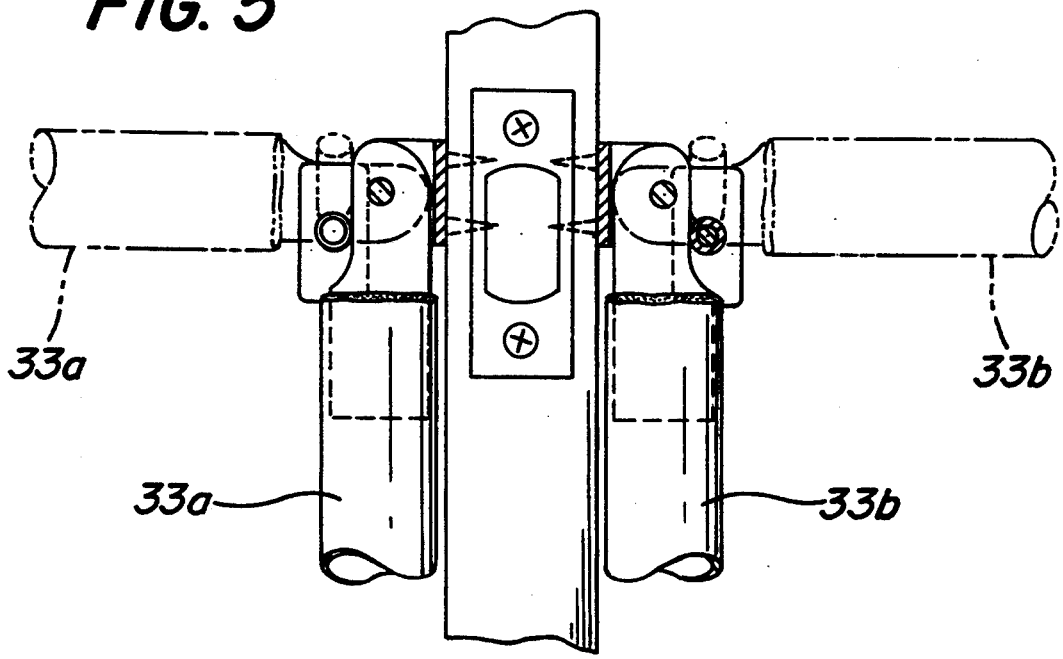
FIG. 5 shows a cross-sectional view taken along lines V—V of FIG. 1.
Figure 6:
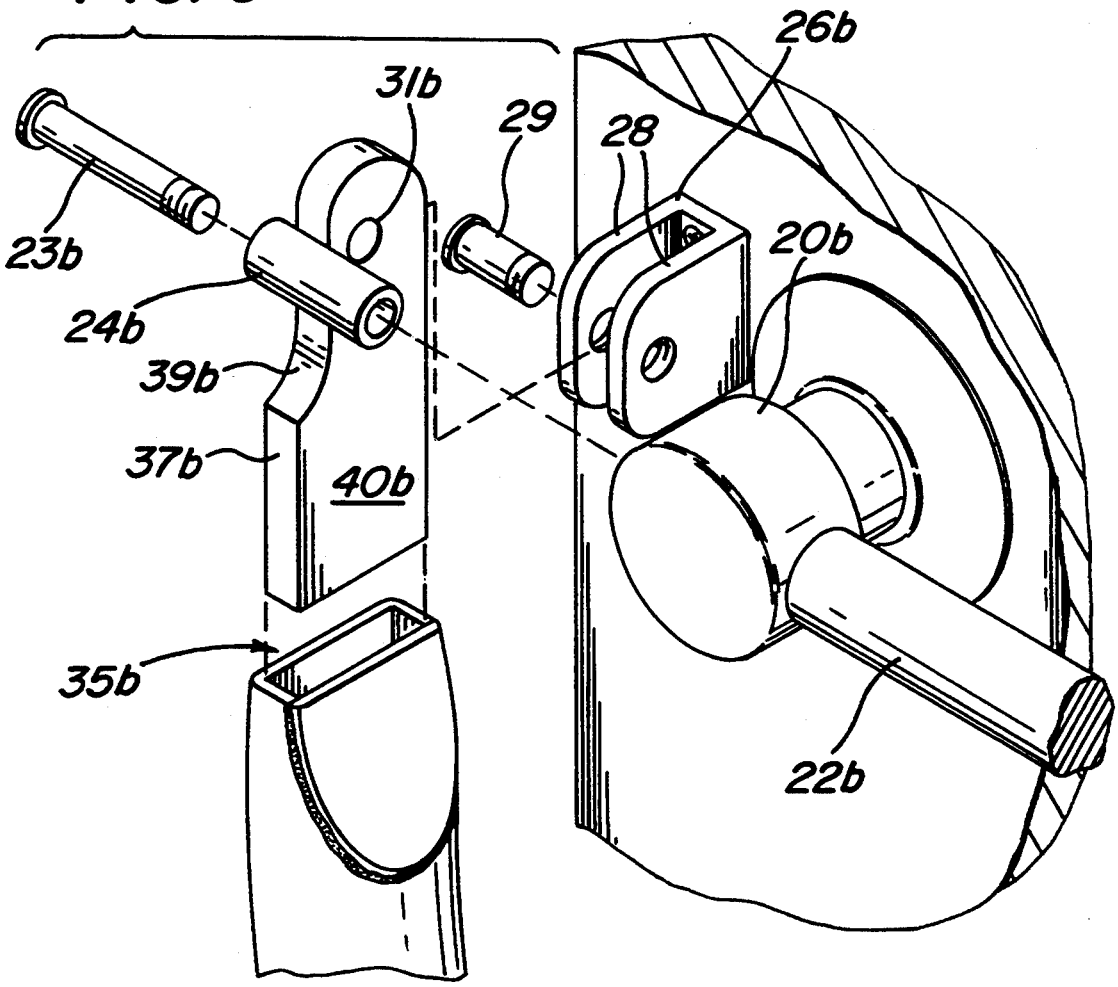
FIG. 6 shows an exploded view of the door latch actuating bar of the instant invention.

As shown in FIGS. 4 and 6, a latch stanchion, or bracket, 26 is fixed to the face of the door, as for instance with wood screws 27 or other similar fasteners, at a predetermined location adjacent latch mechanism 20 and the edge of door 13. Bracket 26 can be a substantially U-shaped piece with flattened legs 28, or any other convenient solid base, for pivot pin 29. As seen, pin 29 is inserted through the aperture in one leg 28, through the aperture 31 in the tip end of a latch actuator 37, and through the aperture in the second leg 28 where it is then secured against removal by means known in the art.

Latch actuator 37, through its pivoting movement about pin 29, uses a load-bearing surface 39 to move latch handle extension 23, as will be explained. Actuator 37 is formed from a 3 inch long section of flat bar stock with an aperture 31 drilled through the tip end. It then has a preselected radius machined into one side, with excess material at the drilled end removed to make that end narrower than free end 40. Finally, the edges near aperture 31 are rounded off to provide adequate clearance from the face of door 13

A hinge stanchion, or bracket, 27 similar to bracket 26 is affixed to the face of door 13 in a predetermined location on hinge stile 18 opposite from bracket 26. Bracket 27 also uses a pin 29 to restrict movement of a bar attachment 44. Bar attachment 44 is also made from a 3 inch long section of flat bar stock, or similar material, and has, at about its lengthwise midpoint, an angle in the range of approximately 45 to 60 degrees therein to form a pivoting end 45 and a free end 46. As with actuator 37, free end 46 remains squared off. Further details of this design and construction can be clearly seen in FIGS. 4 and 5.

One of the features of door opening device 25 is angled grasping bar 30. Bar 30, used for opening door 13, is formed out of tubular material as a generally L-shaped section with its end sections 35 being swaged to compress the outline of their peripheries to conform to free end 40 of actuator 37 and to free end 46 of bar attachment 44. Bar **30*a* has a substantially straight section 51 that turns in to an elbow of approximately 60 degrees. On the other end of elbow 39*a*, an elongated portion 41 continues away and connects with swaged end 35. For better holding purposes, bar 30*a*** may optionally have a knurled surface, as is known.

Bar **30*b*, on the outside of door 11, has a slightly different design, as can be seen in FIG. 3. Instead of a relatively straight portion, as with 51, bar 30*b* uses a slightly curved portion 52. The radius of curvature of portion 52 will depend on the width of door 13 and the thickness of sash 14, as sufficient clearance is required to push portion 52 through the doorway while it is held in a relatively horizontal position. In either case, grasping bar 30 will simply hang from brackets 26 and 27 in a relatively vertical position alongside the face of door 13** when not in use.

Figure 7:
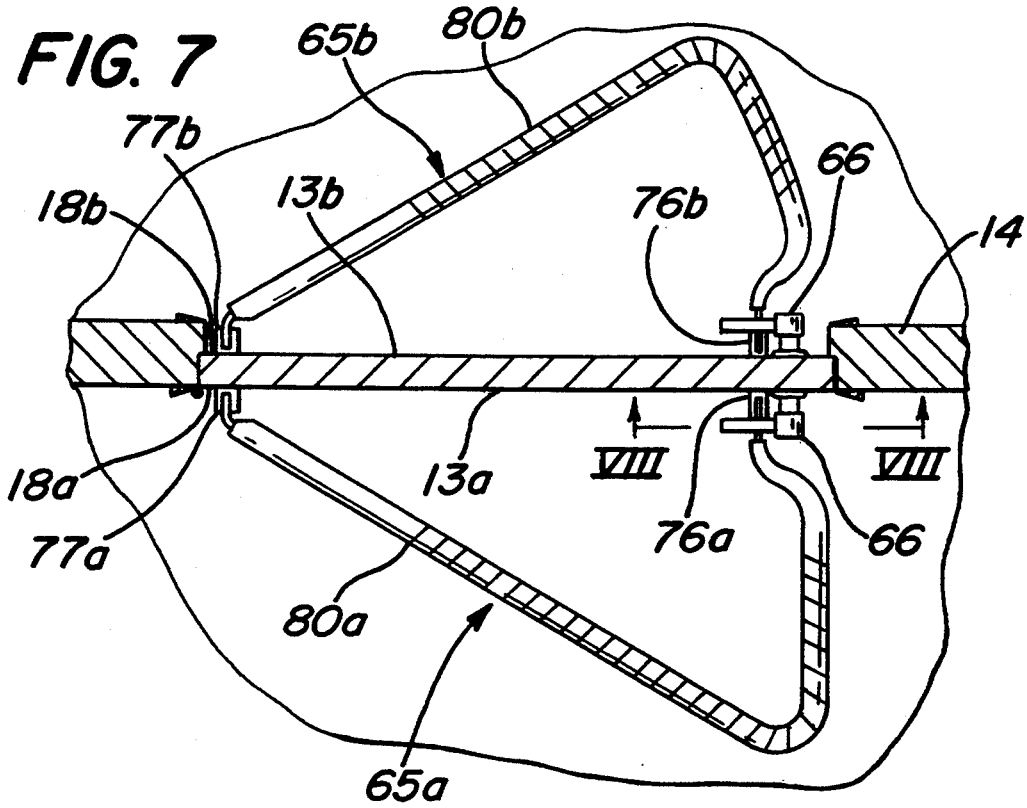
FIG. 7 shows a cross-sectional view, similar to that of FIG. 3, of another embodiment of the invention.
Figure 8:
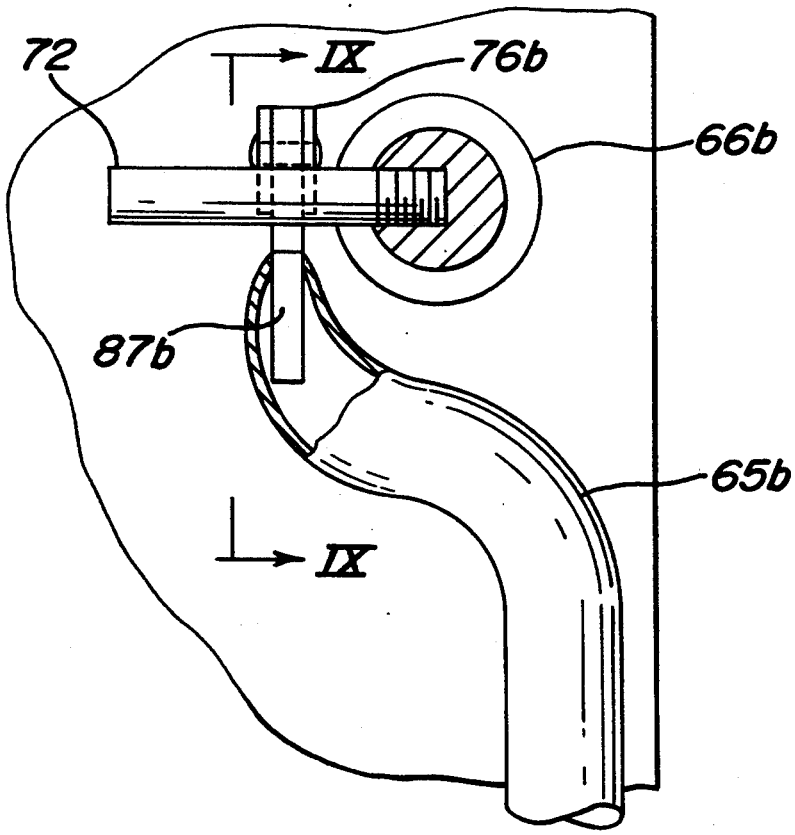
FIG. 8 shows a partially broken away cross-sectional view taken along lines VIII—VIII of FIG. 7 showing the bar in the down, or hanging, position.
Figure 9:
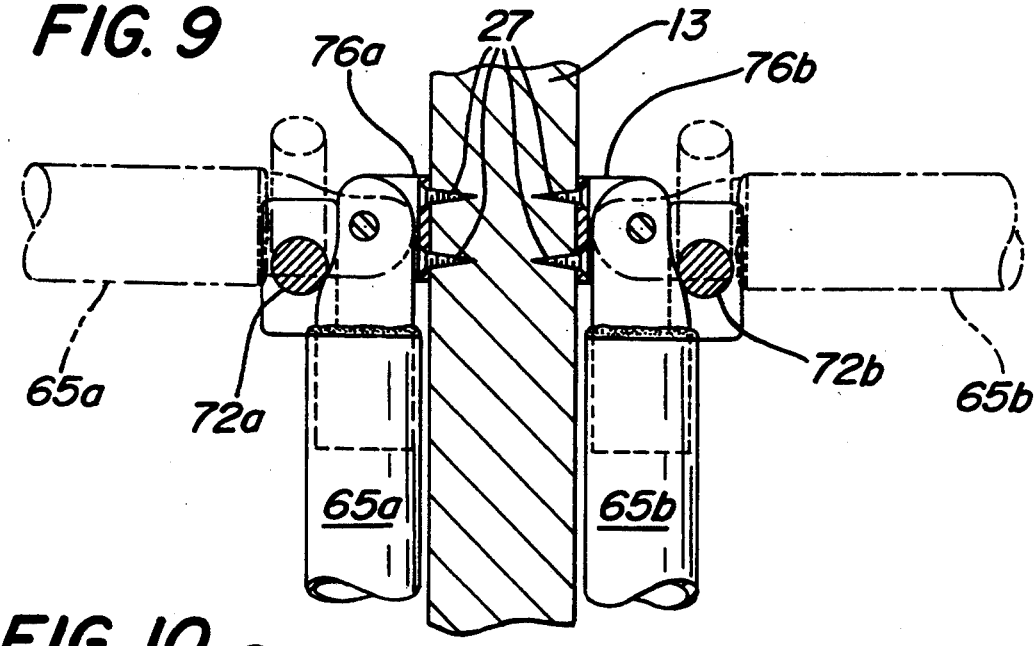
FIG. 9 shows a cross-sectional view taken along lines IX—IX of FIG. 8.
Figure 10:
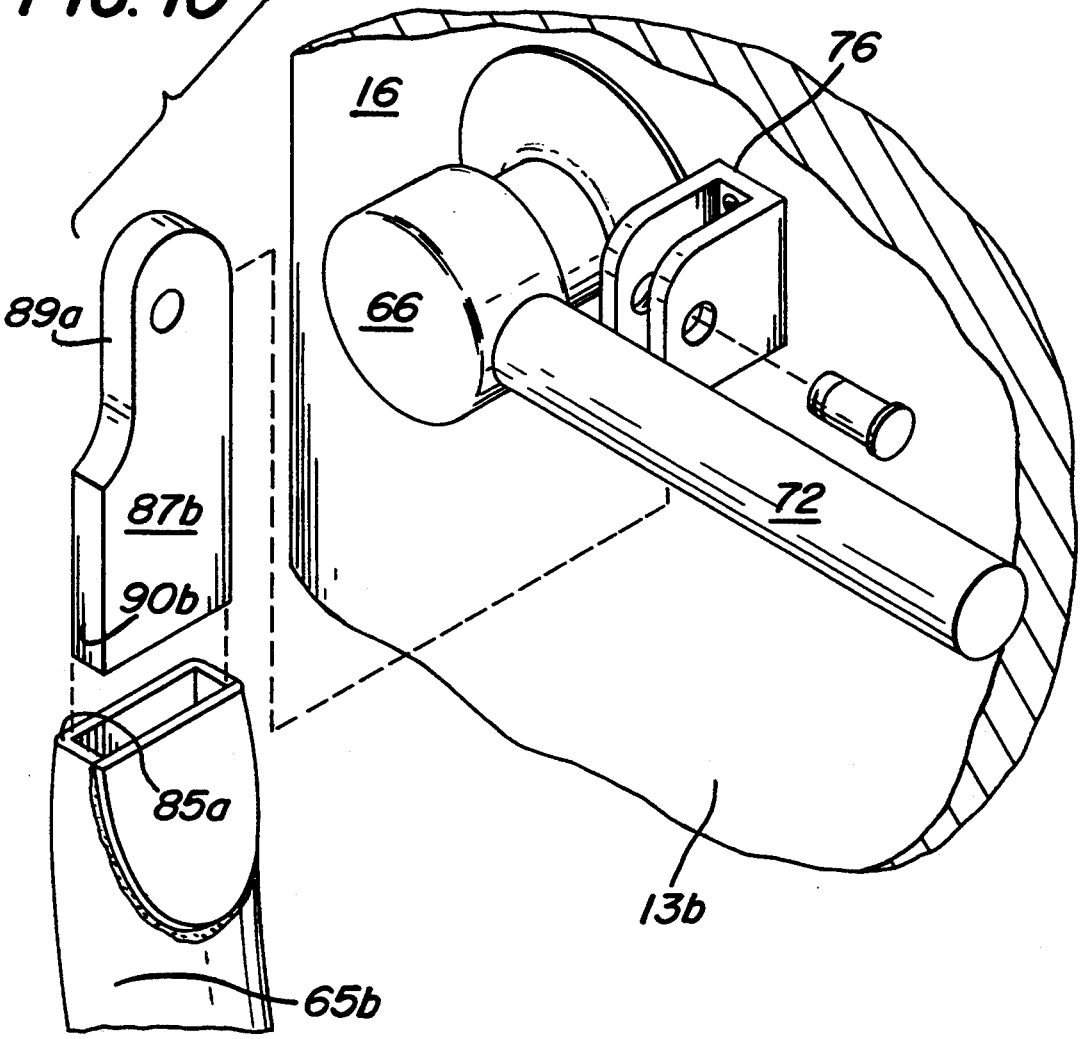
FIG. 10 shows an exploded view of the door latch actuating bar of the other embodiment of the invention.

FIGS. 7 to 10 illustrate a slightly different embodiment, that will now be described. FIG. 7 shows a cross-sectional view, similar to FIG. 3, of this embodiment. As can be seen, door 13 has an inside, or "a" face, and an outside, or "b", face. The door opening device 65 consists of a latch stanchion, or bracket, 76 positioned adjacent a lever-action latch mechanism 66 and a hinge stanchion, or bracket, 77 fixed to the hinge stile 18 as have been earlier described. With this embodiment, latch bracket 76 is fixed to latch stile 16 adjacent latch mechanism 66 and immediately adjacent lever latch handle 72. As can be seen by comparing the two embodiments of FIGS. 3 and 7, grasping bar **65*a* and 65*b* are designed with a slight "S" bend in the portion of bar 65 that joins to latch actuator 87. Swaged end 85*b* is formed as has been previously described and is fixedly attached to free end 90. In this embodiment, load-bearing section 89 contacts the underside of lever latch handle 72 directly. With either embodiment, the load-bearing section and the underside of latch handle 72 or of bar 23** both can be covered with a known PTFE coating, or other similar slippery type material to minimize friction.

Operation:

In the case where door 13 opens in toward a person in a wheelchair, the person first rolls in close enough to the door to grasp bar **25*a* or 65*a*. The person lifts bar 25*a* or 65*a* high enough, generally to approximately a horizontal position, to disengage latch mechanism 20 or 66 and cause door 13 to be free to swing on its hinges (not shown). As bar 25 is lifted and door 13 unlatched, the person backs away from the door so that the door will clear the wheelchair as opening proceeds. Once the person is sufficiently clear of the door, the wheelchair is braked and opening is commenced. The person pulls on bar 25*a* adjacent elbow 39 and pulls in a direction perpendicular to portion 41. A person pulling on the bar at this portion is provided with a greater moment arm than would be attained by simply pulling on latch 22 or 72. This greater moment arm results in a smaller force required to continue door movement. As the door is pulled open, the person alternately grasps and pulls the portion 41 which is perpendicular to the door until the door is in reach. At this point bar 25***a* is left to drop back to the vertical position, the door is pushed aside and the person passes the wheelchair through.

An alternate method can be utilized to simutaneously back away from and open the door. As bar 30 is lifted and door 13 unlatched, the person can alternately push on bar 30 along the axis of portion 41 and pull on bar 30 in a direction perpendicular to portion 41. Pushing along the axis of portion 41 drives the wheelchair away from the door which will allow the door to partially clear the wheelchair. Pulling perpendicular to portion 41 will open the door until it contacts the wheelchair. Such actions are alternately performed until the wheelchair has fully moved away from the door and the door is fully open.

In the case where door 13 opens away from the wheelchair, the person reaches in and grasps bar 25*b* or 65*b* and lifts it to an approximately horizontal position, as before. Once latch mechanism 20*b* or 66*b* is opened, bar 25*b* or 65*b* is positioned approximately horizontal. In this position, the bar allows the person to utilize a greater moment arm, and consequently smaller force, in opening the door than would be obtained by merely pushing against the door. In addition, since the bar acts as an extension of the door, the wheelchair-bound person can keep the door away from the wheelchair as it is passing through the doorway.

Finally, while the door opening device for wheelchair-bound persons has been described with reference to particular embodiments, it should be understood that these embodiments are merely illustrative as there are numerous variations and modifications which may be made by those skilled in the art. Thus, the invention is to be construed as being limited only by the spirit and scope of the appended claims.

What I claim is:

1. An improved door opening device for a door having a face and two vertical edges, said door being attached by hinges from a hinge stile at one edge thereof to a door frame and arranged to be latched to the door frame by a rotatable door latch handle mechanism which extends perpendicular to said face of the door from a latch stile at the opposite edge thereof, to allow a person in a wheelchair to move through the doorway by either unlatching the mechanism and pulling the door open or unlatching the mechanism and pushing the door open, the improvement comprising:

a latch handle extension bar extending from the latch handle mechanism, said extension bar being movable to rotate the latch handle mechanism; and an opening bar pivotally attached to said face of the door and rotatable through approximately ninety degrees from a substantially vertical, hanging position in which it is situated substantially in a plane approximately parallel to the door face, to a substantially horizontal position in which it extends outwardly from said door, and wherein the opening bar has at least two sections joined to form an acute vertex positioned so that it is disposed farthest from said face of the door when the bar is lifted to its substantially horizontal position, and wherein at least one of said sections has a load-bearing surface, said opening bar being positioned so that, as said bar is raised from its hanging position to its substantially horizontal position, said load bearing surface forcibly contacts, and exerts a rotating force on, said latch handle extension bar, causing the latch handle mechanism to unlatch and thereby allowing the door to be opened.

2. An improved door opening device for facilitating movement of a person in a wheelchair through a doorway, said device being installed on a face of a door attached by hinges from a hinge stile at one edge thereof to a door frame and arranged to be latched to the frame by a door latch handle mechanism on a latch stile at an opposite edge thereof, said latch handle mechanism having a portion which is movable upwardly to effect unlatching of the latch handle mechanism, Said portion having an underside, the improvement comprising:

first pivot means attached to the hinge stile on a first face of the door;

second pivot means attached to said door, on said first face thereof, adjacent to the door latch handle mechanism; and an opening bar pivotally attached to said first and said second pivot means and rotatable through approximately ninety degrees from a hanging position, in which the opening bar is situated substantially parallel to the face of the door, to a substantially horizontal position, and wherein the opening bar has at least two sections joined to form an acute vertex positioned so that it is disposed farthest from said face of the door when the bar is lifted to a substantially horizontal position, and wherein at least one of said sections has a load-bearing surface, the opening bar being positioned so that, as it is moved from said hanging position to said substantially horizontal position, the load-bearing surface slidingly contacts the underside of said portion of the latch handle mechanism and unlatches said latch handle mechanism thereby allowing the door to be opened.

3. An improved door opening device as claimed in claim 1 wherein said opening bar comprises a substantially L-shaped bar having first and second connecting bars at opposite ends thereof, said connecting bars being pivotally connected to said hinge stile and said latch stile respectively.

4. An improved door opening device as claimed in claim 3 wherein said opening bar further includes a first bracket and pin and a second bracket and pin.

5. An improved door opening device as claimed in claim 1 wherein said latch handle extension bar comprises a bar extending transverse to the direction of rotation of said latch handle mechanism.

6. An improved door opening device as claimed in claim 2 wherein each of said first and second pivot means comprises a bracket and a pin.

7. An improved door opening device as claimed in claim 2 wherein said opening bar comprises a substantially L-shaped bar having connecting bars at opposite ends thereof, said connecting bars being pivotally connected to said first pivot means and said second pivot means respectively.

8. An improved door opening device as claimed in claim 7 wherein said first and second pivot means respectively include a first bracket and pin and a second bracket and pin.

9. An improved door opening device as claimed in claim 3 wherein one of said connecting bars comprises first and second portions meeting at an angle in the range of approximately 45 to 60 degrees.

10. An improved door opening device as claimed in claim 7 wherein one of said connecting bars comprises first and second portions meeting at an angle in the range of approximately 45 to 60 degrees.

11. An improved door opening device for a door attached by hinges from a hinge stile at one edge thereof to a door frame and arranged to be latched to the frame by a door latch handle mechanism on a latch stile at an opposite edge thereof, for facilitating entry and exit by a person in a wheelchair through a doorway, the improvement comprising:

a latch extension bar attached to the latch handle mechanism;

first and second brackets attached to the door approximately midway between the top and bottom of the door, the first bracket being affixed to the hinge stile and the second bracket being affixed to the latch stile adjacent to the latch handle mechanism;

a first, angled, connecting bar;

a second, substantially straight, connecting bar;

first pin means pivotally attaching said first connecting bar to said first bracket;

second pin means pivotally attaching said second connecting bar to said second bracket; and an opening bar in the form of two sections joined at an acute angle, connected to said first and second connecting bars;

at least one of said connecting bars between said opening bar and said second bracket having means for engaging said latch extension bar to operate said latch handle mechanism upon upward rotation of said opening bar about said first and second pins.

12. An improved door opening device as claimed in claim 2 wherein one of said sections of the opening bar is substantially straight and pivoted to said first pivot means, and forms a first angle with the face of the door upon raising the bar to the substantially horizontal position, and the other of said sections of the opening bar is pivoted to said second pivot means and forms a second angle with the face of the door upon raising the bar to the substantially horizontal position, the second angle being greater than the first angle, whereby said acute vertex is located approximately in front of said latch stile and said one of said sections extends from said acute vertex toward said first pivot means obliquely to the face of the door in a substantially straight line.

13. An improved door opening device as claimed in claim 12 in which said other of said sections is disposed substantially perpendicular to said face of the door.

* * * * *